US006022077A

United States Patent [19]

Kirkland et al.

[11] Patent Number: 6,022,077

[45] Date of Patent: Feb. 8, 2000

[54] ONE-SHOT PEDESTAL SWIVEL SEAT LOCK/RELEASE MECHANISM

[75] Inventors: Rex Allen Kirkland, Lancaster; Bobby Leo Woodward, Mabank, both of Tex.

[73] Assignee: Brunswick Corporation, Lake Forest, Ill.

[21] Appl. No.: 09/188,084

[22] Filed: Nov. 6, 1998

Related U.S. Application Data

[63] Continuation of application No. 08/852,592, May 7, 1997, abandoned.

[51] Int. Cl.[7] ..... F16M 11/00

[52] U.S. Cl. ..... 297/344.19; 297/344.22; 297/463.1; 248/404

[58] Field of Search ..... 297/344.19, 5.22, 297/463.1, 300.3, 301.2; 292/61; 248/404

[56] References Cited

U.S. PATENT DOCUMENTS

| | | | |
|---|---|---|---|
| 701,238 | 5/1902 | Williams | 292/61 |
| 1,966,205 | 7/1934 | Johnson | 292/61 X |
| 2,054,557 | 9/1936 | Cramer et al. | 297/344.22 X |
| 2,909,247 | 10/1959 | Romito . | |
| 3,158,387 | 11/1964 | Martin | 292/61 X |
| 3,307,820 | 3/1967 | Martin | 297/344.19 X |
| 3,674,308 | 7/1972 | Radding | 297/344.21 X |
| 3,756,654 | 9/1973 | Bauer . | |
| 3,848,921 | 11/1974 | Rhodes . | |
| 3,858,834 | 1/1975 | Eimen | 297/344.22 X |
| 3,885,764 | 5/1975 | Pabreza | 248/162.1 |
| 3,950,027 | 4/1976 | Wilson | 248/118 X |
| 4,113,221 | 9/1978 | Wehner | 292/61 X |
| 4,408,800 | 10/1983 | Knapp | 297/301.2 |
| 4,518,139 | 5/1985 | Barfell . | |
| 4,673,155 | 6/1987 | Binder . | |
| 4,756,496 | 7/1988 | Hosan et al. . | |
| 4,779,925 | 10/1988 | Heinzel . | |
| 5,218,139 | 6/1993 | Barfell | 297/344.22 X |
| 5,253,922 | 10/1993 | Corlett . | |
| 5,568,960 | 10/1996 | Oleson et al. | 297/344.22 |
| 5,634,537 | 6/1997 | Thorn | 297/344.22 X |

FOREIGN PATENT DOCUMENTS

| | | | |
|---|---|---|---|
| 549026 | 6/1993 | European Pat. Off. | 297/301.2 |
| 1016802 | 11/1952 | France | 248/415 |
| 645643 | 2/1979 | Russian Federation . | |
| 0645643 | 2/1979 | U.S.S.R. | 248/415 |
| 1434127 | 5/1976 | United Kingdom | 248/418 |

*Primary Examiner*—Jose V. Chen
*Assistant Examiner*—David E. Allred
*Attorney, Agent, or Firm*—Duane, Morris & Heckscher, LLP

[57] ABSTRACT

A pedestal assembly for a boat seat is disclosed which combines in a single lever adjustment the ability to raise and lower the seat as well as to lock or unlock the seat to permit clockwise and counterclockwise swivel action. The lever is pulled up for vertical adjustments up or down. The lever is pushed down facilitating clockwise or counterclockwise pivoting about the pedestal of the seat. When the lever is released it is spring-biased to a neutral position. Depending on the configuration, the seat can be locked in one or more swivelled positions about the pedestal. The seat can be easily detached from the pedestal through a mechanism which remains on the seat mount so that it will not be lost in the boat or overboard. The detachment pin assembly also provides positive feedback that the seat has been properly secured to the pedestal and locked.

17 Claims, 3 Drawing Sheets

ONE-SHOT PEDESTAL SWIVEL SEAT LOCK/RELEASE MECHANISM

This is a continuation of application Ser. No. 08/852,592, filed on May 7, 1997, now abandoned.

FIELD OF THE INVENTION

The field of this invention relates to pedestal supports, particularly supports useful for boat chairs which incorporate height and swivel control.

BACKGROUND OF THE INVENTION

Height-adjustable pedestal chairs have been in existence for many years. Some prior designs have incorporated adjustment for tilting of the back of the chair, while others have incorporated fairly complex assemblies of cranks or levers to make the individual adjustments. Typical of some of these prior designs for pedestals for adjustable chairs are U.S. Pat. Nos. 2,909,247; 3,756,654; 3,848,921; 4,673,155; 4,779,925; and 5,253,922.

One of the things that the prior designs have not incorporated is a simple adjustable pedestal that allows for height adjustments up or down, as well as an ability to permit swiveling clockwise or counterclockwise about the pedestal, and locking the position of the seat in a variety of positions in a manner that is accomplished through the use of a unitary lever. Thus, one of the objectives of the present invention is to provide such a simple design where a single lever is useful in allowing height adjustments up or down as well as swivel motions clockwise or counterclockwise, coupled with locking the chair in one or more different swivel positions. Another objective of the invention is to allow for rapid removal of the seat from the pedestal in conjunction with an easily operable locking mechanism that facilitates rapid dismantling and feedback to the fisherman that the seat has been properly relatched to the pedestal.

SUMMARY OF THE INVENTION

A pedestal assembly for a boat seat is disclosed which combines in a single lever adjustment the ability to raise and lower the seat as well as to lock or unlock the seat to permit clockwise and counterclockwise swivel action. The lever is pulled up for vertical adjustments up or down. The lever is pushed down facilitating clockwise or counterclockwise pivoting about the pedestal of the seat. When the lever is released it is spring-biased to a neutral position. Depending on the configuration, the seat can be locked in one or more swivelled positions about the pedestal. The seat can be easily detached from the pedestal through a mechanism which remains on the seat mount so that it will not be lost in the boat or overboard. The detachment pin assembly also provides positive feedback that the seat has been properly secured to the pedestal and locked.

DETAILED DESCRIPTION OF THE PREFERRED EMBODIMENT

Figure 2:
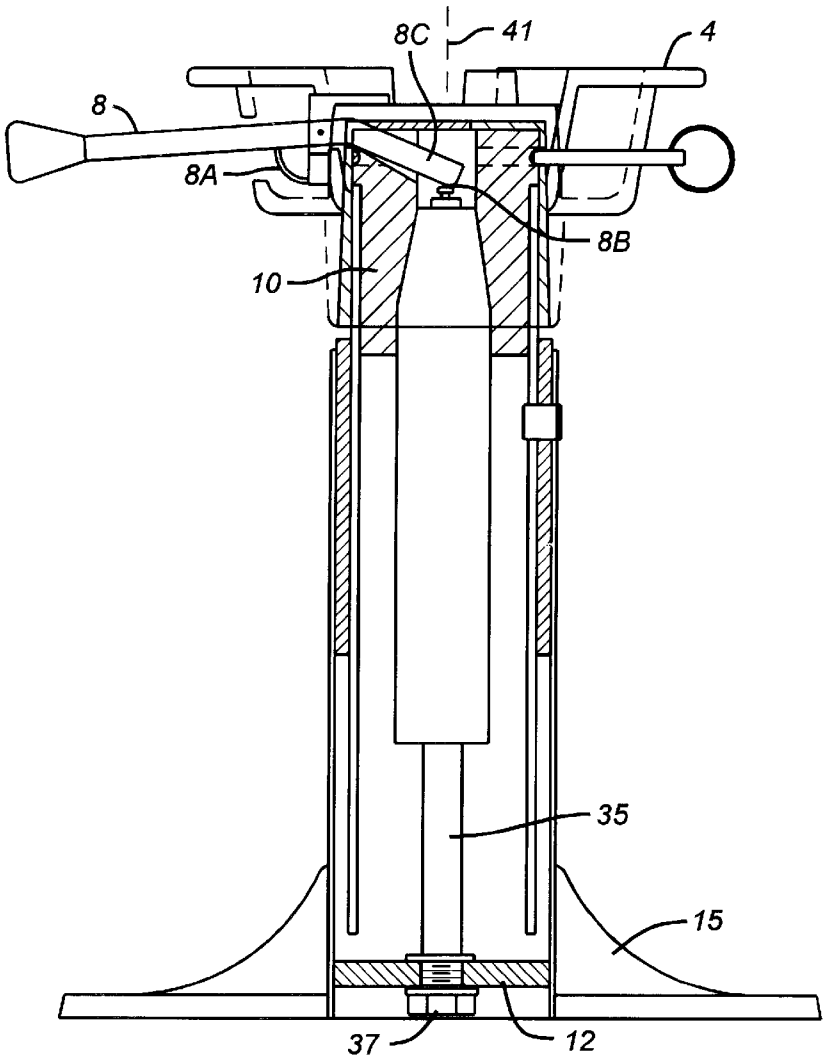
FIG. 2 is a sectional elevational view of the pedestal of the present invention with the lever in the neutral position.
Figure 1:
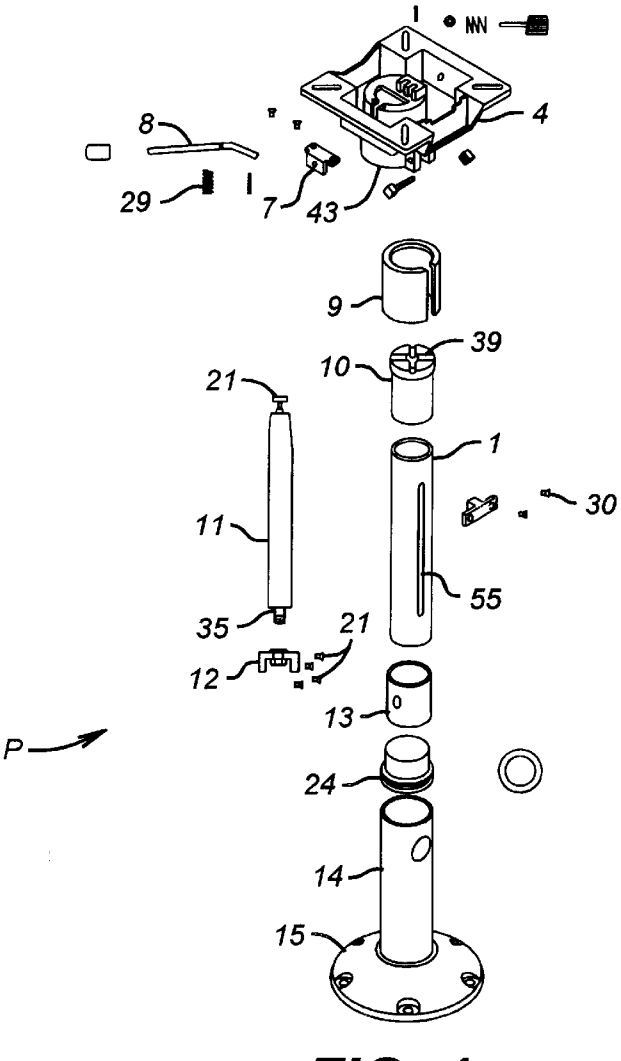
FIG. 1 is an exploded view of the pedestal of the present invention.

The pedestal assembly P is shown in FIG. 1 in exploded view. There a base 15 supports an outer tube 14. A power cylinder base 12 (see FIG. 2 for its location) supports a gas-filled power cylinder 11 within sliding inner tube 1. The power cylinder 11 has a piston 35 which is connected to power cylinder base 12 as shown in FIG. 2. The power cylinder base 12 is secured by fasteners to the base 15 and the piston 35 is secured by nut 37 to power cylinder base 12.

Figure 4:
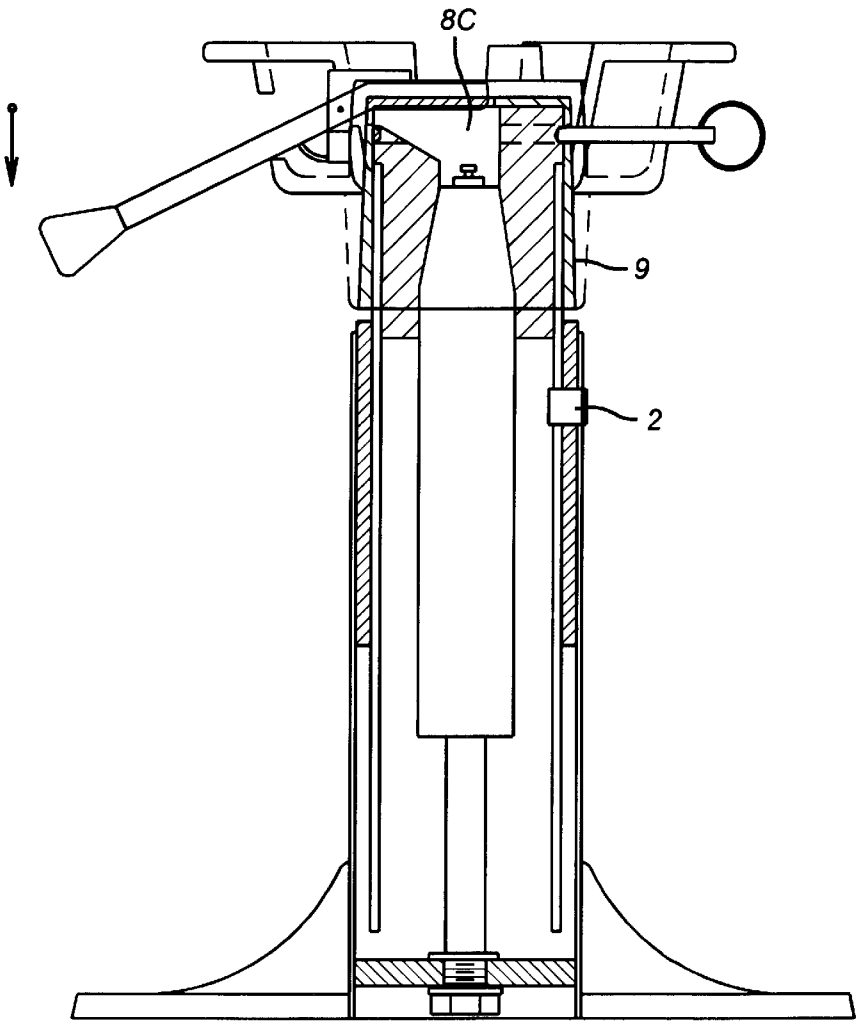
FIG. 4 is the view of FIG. 2 with the lever in the down position.

As shown in FIG. 2, handle 8 extends through the seat mount 4 and through handle pivot hole 7 (see FIG. 1). The end 8C is bent so that in the neutral position shown in FIG. 2, it extends into one of several grooves 39 in locking insert 10. As shown in FIG. 1, locking insert 10 has four grooves disposed at 90°; however more or fewer grooves can be used at different orientations without departing from the spirit of the invention. Locking insert 10 is secured to sliding inner tube 1. In the neutral position of FIG. 2 with the end 8C of the handle 8 extending into one of the grooves 39, the seat mount 4 is precluded from rotating in a horizontal plane about longitudinal axis 41. In order to allow the seat mount 4, which supports the seat (not shown) to rotate in an horizontal plane about axis 41, the lever 8 must be pushed downwardly as shown in FIG. 4. When this occurs, the bent end 8C lifts up out of one of the grooves 39 of locking insert 10, thereby allowing the seat mount 4 to rotate with respect to locking insert 10.

Figure 3:
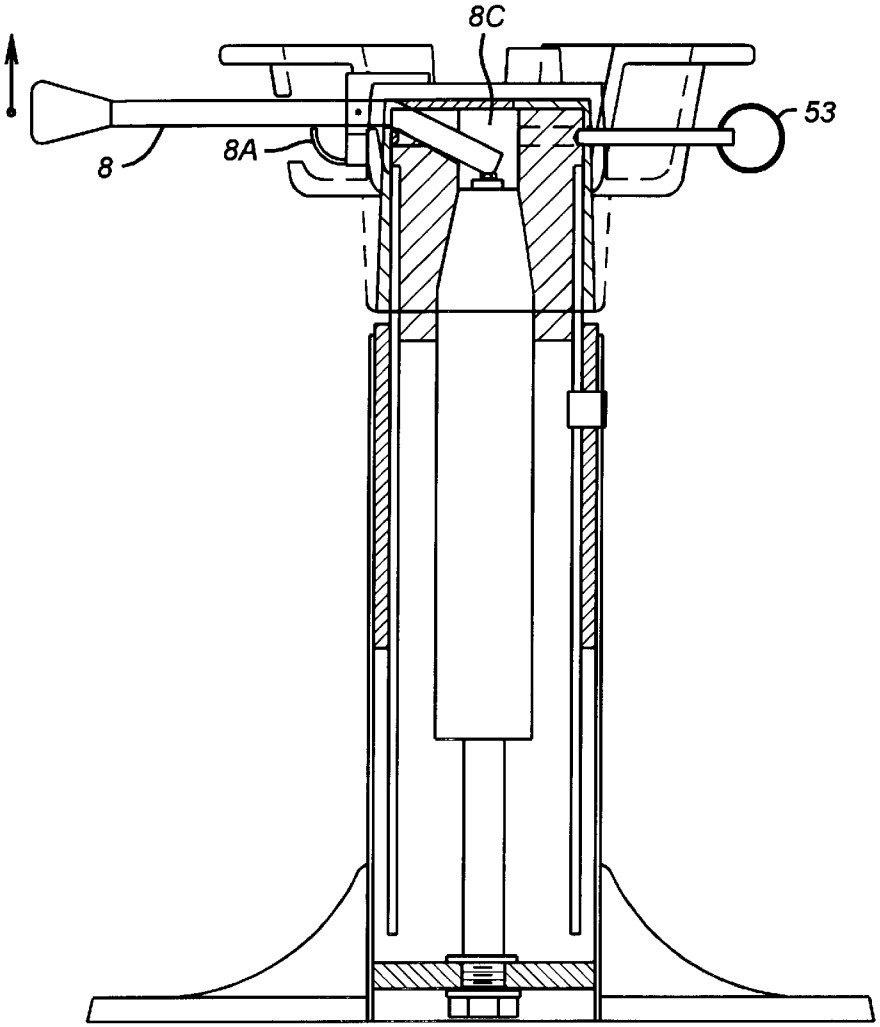
FIG. 3 is the view of FIG. 2 with the lever in the up position.

With an upward pull of lever 8 as shown in FIG. 3, the vertical height of the seat mount 4 can be adjusted. When the handle 8 is pulled upwardly as shown in FIG. 3, the bent component 8C of handle 8 contacts the actuating pin 21 of cylinder 11 and forces it down. The movement of pin 21 can be readily seen by comparing the neutral position of FIG. 2, where the tip 8B is in contact but not pushing on actuating pin 21, and FIG. 3, where tip 8B is depressing pin 21. In the position shown in FIG. 3, the seat mount 4 can be raised or lowered as desired to an appropriate position, and leaf spring 8A (which can be a torsion spring or any other kind of spring) can be used as shown in FIG. 2 to return the lever 8 to its neutral position. Thus, when the lever 8 is released from the position shown in FIGS. 3 or 4, it can return to the position shown in FIG. 2. If, when lever 8 is released, the end 8C is not in alignment with a groove 39, the seat mount 4 can rotate clockwise or counterclockwise until end 8C aligns with a groove 39, at which time spring 8A will bias handle 8 to the neutral position.

The seat mount 4 has a tubular body 43 which is secured by bolt 6 and nut 5 over bushing 9. Bushing 9 fits rotatably over inner tube 1.

Figure 6:
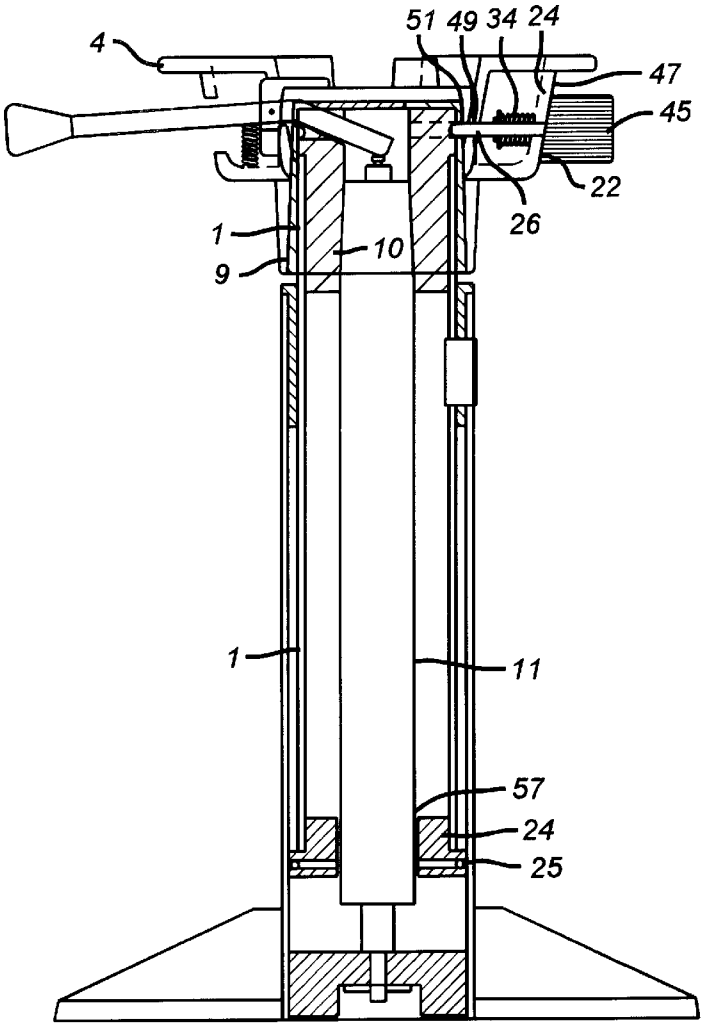
FIG. 6 is the view of FIG. 2 with an alternative disconnect to the pull pin shown in FIG. 2.

Referring to FIG. 6, knob 45 has a slanted surface 22, which when aligned with wall 47 of seat mount 4 allows plunger 26 to extend through opening 49 in seat mount 4 and through a groove 51 in locking insert 10. As previously stated, latching insert 10 is secured inside inner tube 1. Plunger 26 goes into groove 51 in insert 10. Groove 51 extends out beyond the end of inner tube 1. The plunger 26 also goes through an opening (not shown) in bushing 9, which is secured within the tubular body 43 of seat mount 4. In the position shown in FIG. 6, with the plunger 26 extending into groove 51 of locking insert 10, the seat mount 4 cannot be removed. However, 90° rotation of knob 45 retracts the plunger 26 against the bias of spring 34, allowing the seat mount 4 to be removed off of the locking insert 10. FIG. 3 shows the same concept, however, using a pin 53 which is manually inserted or removed from groove 51 in locking insert 10 to selectively secure or release the seat mount 4 to the locking insert 10. It can have a chain on it to prevent its loss.

Figure 5:
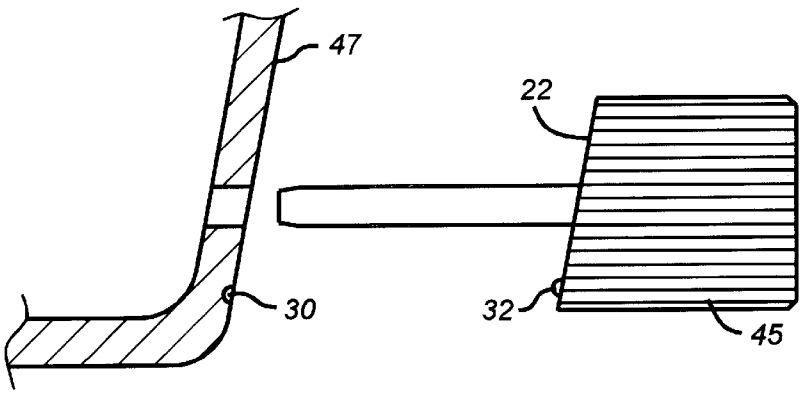
FIG. 5 is a detailed view of the release knob shown in FIG. 6, indicating how the feedback feature operates that tells the fisherman that the seat mount is firmly latched to the pedestal.

FIG. 5 shows a detail of the knob 45 and plunger 26 illustrated in FIG. 6. The biasing spring 34, which is affixed to the plunger 26, keeps the knob 45 from becoming disconnected with the seat mount 4. FIG. 5 illustrates in more detail knob 45 showing the slanted surface 47 which has a projection 32 thereon. FIG. 5 is in exploded view with the spring 34 removed for clarity. It can be seen that the fully extended position of the plunger 26 is defined by alignment of surface 47 with surface 29. When those two surfaces align, the projection 32 will align with the depression 30. The fisherman will feel or hear an audible click when this occurs to alert him or her that the plunger 26 is fully extended and the seat (not shown) and the seat mount 4 are fully secured to locking insert 10. Although one set of a projection 32 and matching depression 30 is shown in FIG. 5, additional numbers of projections 32 and depressions 30 can be used without departing from the spirit of the invention. Other comparable techniques to the projection and depression can also be used so that the operator can have audible or physical feedback that the plunger 26 is fully extended and secures the seat mount 4 to the sliding inner tube 1.

Those skilled in art will appreciate that depressing pin 21 results in an extension of piston 35, which raises up or allows lowering of the sliding inner tube 1 and along with it the locking insert 10 and finally the seat mount 4. Applying a downward force to the seat mount 4, with the lever 8 in the up position as shown in FIG. 3, allows the cylinder 11 to move downwardly over the piston 35 so that the elevation of the seat mount 4 is reduced.

Thus, with the lever 8 moved upwardly as shown in FIG. 3, the height of the pedestal is adjusted. That same lever 8 moved downwardly pulls out end 8C from one of the grooves 39 to allow rotation of seat mount 4 with lever 8 about longitudinal axis 41. Rotation about a horizontal plane perpendicular to longitudinal axis 41 can stop with the end 8C not fully situated within the groove 39. The seat mounted to the seat mount 4 can in that condition rotate about the longitudinal axis 41 in either a clockwise or counterclockwise direction until such time that the end 8C comes back into alignment with one of the grooves 39. At that time, the spring 8A biases the end 8C into groove 39 to lock the seat mount 4 against rotation clockwise or counterclockwise.

The sliding inner tube 1 has an elongated slot 55 into which extends inner/outer tube lock 2 so as to retain the outer tube 14 to the inner tube 1 and to rotationally lock them together. Located at the top of outer tube 14 is inner/outer tube bushing 13. A closure 24 accepts an O-ring seal 25 to define the lower end 57 of the cylinder 11.

Thus, in a single handle 8 a control is presented for raising and lower the seat mount 4 which supports the seat (not shown), as well as regulation of clockwise or counterclockwise rotation of the seat mount 4. A mere upward pull on the handle 8 allows for vertical adjustment, while a downward push permits horizontal, clockwise or counterclockwise rotation about a vertical axis 41, as a retention mechanism as shown in FIG. 6 secures the seat mount 4 until it is deliberately defeated by rotation of knob 45 with an upward pull given to the seat. This results in the seat (not shown) with the seat mount 4 and bushing 9 coming off of inner tube 1 as detent or plunger 26 comes out of not only the locking insert 10 but also the sliding inner tube 1 which surrounds the locking insert 10.

The foregoing disclosure and description of the invention are illustrative and explanatory thereof, and various changes in the size, shape, and materials, as well as in the details of the illustrated construction, may be made without departing from the spirit of the invention.

We claim:

1. A pedestal assembly for a boat seat, comprising:

a base;

a tube structure comprising at least one recess substantially at one end thereon, said tube structure having a longitudinal axis, said tube structure movably mounted with respect to said base;

said base comprises a power cylinder connecting said base to said tube structure and having an actuating pin thereon;

a seat mount supported by said tube structure;

a single lever extending through and pivotally attached to said seat mount and selectively insertable into said recess to interengage said tube structure to said seat mount, thereby mechanically locking them together to prevent seat mount rotation about said longitudinal axis, said lever further movable to engage said pin, thus actuating said power cylinder for longitudinal movement of said seat mount relative to said base.

2. The assembly of claim 1, wherein:

said lever is operable into a first position to facilitate said longitudinal movement of said tube structure by engaging said pin while extended through said recess, and in a second position to facilitate said rotational movement of said seat mount by movement out of said recess.

3. The assembly of claim 2, wherein:

said lever is operable in a third position where longitudinal movement of said tube structure and rotation of said seat mount cannot occur by positioning said lever in said recess without said lever actuating said pin.

4. The assembly of claim 3, wherein:

said lever is biased to said third position.

5. The assembly of claim 1, wherein:

said seat mount further comprises a locking member on said seat mount which selectively precludes removal of said seat mount from said tube structure while not interfering with said rotational movement of said seat mount.

6. The assembly of claim 5, wherein:

said locking member is mounted to said seat mount both in a locked position where said seat mount cannot be removed from said tube structure and in an unlocked position where said seat mount can be removed from said tube structure.

7. The assembly of claim 5, wherein:

said locking member further comprises a knob having a plunger extending through said seat mount thereby allowing selective engagement with said tube structure;

said tube structure comprises a circumferential groove to accept said plunger.

8. A pedestal assembly for a boat seat, comprising:

a base;

a tube structure comprising at least one recess thereon, said tube structure having a longitudinal axis, said tube structure movably mounted with respect to said base;

said base comprises a power cylinder connecting said base to said tube structure and having an actuating pin thereon;

a seat mount supported by said tube structure;

a single lever pivotally attached to said seat mount and selectively insertable into said recess to interengage said tube structure to said seat mount, thereby mechanically locking them together to prevent seat mount rotation about said longitudinal axis, said lever further movable to engage said pin for longitudinal movement of said seat mount;

said seat mount further comprises a locking member on said seat mount which selectively precludes removal of said seat mount from said tube structure while not interfering with said rotational movement of said seat mount;

said locking member further comprises a knob having a plunger extending through said seat mount thereby allowing selective engagement with said tube structure;

said tube structure comprises a circumferential groove to accept said plunger;

said seat mount comprises a first sloping surface with respect to said longitudinal axis of said tube;

said knob having a second sloping surface which, when parallel said first sloping surface, allows said plunger to extend in said groove.

9. The assembly of claim 8, wherein:

said first and second sloping surfaces further comprise at least one projection on one of said sloping surfaces and at least one depression on the other of said sloping surfaces;

said depression aligning with said projection when said sloping surfaces are substantially parallel to each other as a signal that said plunger has entered said groove.

10. A pedestal assembly for a boat seat, comprising:

a base;

a tube structure comprising at least one recess thereon, said tube structure having a longitudinal axis, said tube structure movably mounted with respect to said base;

said base comprises a power cylinder connecting said base to said tube structure and having an actuating pin thereon;

a seat mount supported by said tube structure;

a single lever pivotally attached to said seat mount and selectively insertable into said recess to interengage said tube structure to said seat mount, thereby mechanically locking them together to prevent seat mount rotation about said longitudinal axis, said lever further movable to engage said pin for longitudinal movement of said seat mount;

said lever is operable into a first position to facilitate said longitudinal movement of said tube structure by engaging said pin while extended through said recess, and in a second position to facilitate said rotational movement of said seat mount by movement out of said recess;

said lever is operable in a third position where longitudinal movement of said tube structure and rotation of said seat mount cannot occur by positioning said lever in said recess without said lever actuating said pin;

said lever comprising an end which extends through said seat mount and into said recess when said lever is in its said third position, said lever end moving out of said recess when said lever is moved to said second position.

11. The assembly of claim 10, wherein:

said tube structure further comprises an upper end and a locking insert mounted on said upper end of said tube structure, said recess disposed on said locking insert;

said locking insert further comprises a groove;

said seat mount further comprises a locking assembly insertable in said groove to secure said seat mount to said locking insert while permitting relative rotation as said locking assembly moves with respect to said groove.

12. The assembly of claim 10, wherein:

said lever is biased to said third position.

13. A pedestal assembly for a boat seat, comprising:

a base;

a tube structure comprising at least one recess thereon, said tube structure having a longitudinal axis, said tube structure movably mounted with respect to said base;

said base comprises a power cylinder connecting said base to said tube structure and having an actuating pin thereon;

a seat mount supported by said tube structure;

a single lever pivotally attached to said seat mount and selectively insertable into said recess to interengage said tube structure to said seat mount, thereby mechanically locking them together to prevent seat mount rotation about said longitudinal axis, said lever further movable to engage said pin for longitudinal movement of said seat mount;

said lever is operable into a first position to facilitate said longitudinal movement of said tube structure by engaging said pin while extended through said recess, and in a second position to facilitate said rotational movement of said seat mount by movement out of said recess;

said lever is operable in a third position where longitudinal movement of said tube structure and rotation of said seat mount cannot occur by positioning said lever in said recess without said lever actuating said pin;

said seat mount further comprises a locking member on said seat mount which selectively precludes removal of said seat mount from said tube structure while not interfering with said rotational movement of said seat mount.

14. The assembly of claim 13, wherein:

said locking member is mounted to said seat mount both in a locked position where said seat mount cannot be removed from said tube structure and in an unlocked position where said seat mount can be removed from said tube structure.

15. The assembly of claim 13, wherein:

said locking member further comprises a knob having a plunger extending through said seat mount thereby allowing selective engagement with said tube structure;

said tube structure comprises a circumferential groove to accept said plunger.

16. The assembly of claim 15, wherein:

said seat mount comprises a first sloping surface with respect to said longitudinal axis of said tube;

said knob having a second sloping surface which, when parallel said first sloping surface, allows said plunger to extend in said groove.

17. The assembly of claim 16, wherein:

said first and second sloping surfaces further comprise at least one projection on one of said sloping surfaces and at least one depression on the other of said sloping surfaces;

said depression aligning with said projection when said sloping surfaces are substantially parallel to each other as a signal that said plunger has entered said groove.

* * * * *